US011668545B2

(12) United States Patent
Arnedo Vera et al.

(10) Patent No.: US 11,668,545 B2
(45) Date of Patent: Jun. 6, 2023

(54) PELLET MAGAZINE FOR AIR RIFLES AND PISTOLS

(71) Applicant: GAMO OUTDOOR, S.L., Sant Boi de Llobregat (ES)

(72) Inventors: Julian Arnedo Vera, Sant Boi de Llobregat (ES); Antonio Fidel Núñez Morales, Sant Boi de Llobregat (ES); Desiderio Falcó Sastre, Sant Boi de Llobregat (ES)

( * ) Notice: Subject to any disclaimer, the term of this patent is extended or adjusted under 35 U.S.C. 154(b) by 0 days.

(21) Appl. No.: 17/625,400

(22) PCT Filed: Jul. 31, 2020

(86) PCT No.: PCT/ES2020/070497
§ 371 (c)(1),
(2) Date: Jan. 10, 2022

(87) PCT Pub. No.: WO2021/023906
PCT Pub. Date: Feb. 11, 2021

(65) Prior Publication Data

US 2022/0221245 A1 Jul. 14, 2022

(30) Foreign Application Priority Data

Aug. 2, 2019 (WO) ..... PCT/ES2019/070552

(51) Int. Cl.
*F41B 11/54* (2013.01)

(52) U.S. Cl.
CPC ..... *F41B 11/54* (2013.01)

(58) Field of Classification Search
CPC ..... F41B 11/00; F41B 11/50; F41B 11/54; F41B 11/55; F41B 11/70; F41B 11/89
USPC ..... 124/45, 48, 51.1, 56
See application file for complete search history.

(56) References Cited

U.S. PATENT DOCUMENTS 926,546 A * 6/1909 Cox ..... F41B 11/54 124/48
2,962,017 A * 11/1960 Horowitz ..... F41B 7/006 124/48
3,782,359 A * 1/1974 Kester ..... F41B 11/62 124/48
3,818,887 A * 6/1974 Akiyama ..... F41B 11/646 124/67
3,913,553 A * 10/1975 Braughler ..... F41B 11/54 124/48
4,850,328 A * 7/1989 Sindel ..... F41B 11/55 124/66
4,986,251 A * 1/1991 Lilley ..... F41B 11/55 124/52
4,993,400 A * 2/1991 Fitzwater ..... F41B 11/54 124/48
5,150,701 A * 9/1992 Wackrow ..... F41B 11/57 124/52

(Continued)

*Primary Examiner* — Alexander R Niconovich
(74) *Attorney, Agent, or Firm* — Patrick Stanzione; Stanzione & Associates, PLLC

(57) ABSTRACT

A pellet magazine for air compressed rifle and pistols, comprising an outer casing, inside which a drum is placed having housings for housing the pellets, a through hole that extends, at least partially, throughout the rotation axis to the drum, a channel through which passes a limit stop that prevents the rotation of a pellet and consequently the drum, a joint which holds and repositions the pellets, and an axis around which the drum rotates.

28 Claims, 15 Drawing Sheets

(56) References Cited

U.S. PATENT DOCUMENTS

| | | | | |
|---|---|---|---|---|
| 5,205,270 | A * | 4/1993 | Szente | F41B 11/55 124/56 |
| 6,470,871 | B2 * | 10/2002 | Casas-Salva | F41B 11/54 124/67 |
| 6,530,368 | B1 * | 3/2003 | Maeda | F41B 11/55 124/48 |
| 6,796,300 | B2 * | 9/2004 | Petrosyan | F41B 11/55 124/48 |
| 7,159,584 | B2 * | 1/2007 | Maeda | F41A 9/73 89/33.02 |
| 8,291,894 | B2 * | 10/2012 | Barwick, Jr. | F41B 11/55 124/45 |
| 8,360,043 | B2 * | 1/2013 | Casas Salva | F41B 11/723 124/72 |
| 8,931,467 | B2 * | 1/2015 | Lee | F41A 9/26 124/56 |
| 9,134,090 | B1 * | 9/2015 | Park | F41B 11/55 |
| 9,664,475 | B1 * | 5/2017 | Maggiore | F41B 11/54 |
| 10,066,896 | B2 * | 9/2018 | Zhu | F41B 11/50 |
| 10,197,355 | B2 * | 2/2019 | Lamboy | F41B 11/683 |
| 10,267,593 | B2 * | 4/2019 | Lamboy | F41B 11/54 |
| 10,371,473 | B1 * | 8/2019 | Wei | F41A 9/76 |
| 10,393,474 | B2 * | 8/2019 | Sullivan | F41B 11/50 |
| 11,002,508 | B2 * | 5/2021 | Miller | F41B 11/50 |
| 11,098,976 | B2 * | 8/2021 | Call | F41B 11/54 |
| 11,156,416 | B2 * | 10/2021 | Arnedo Vera | F41A 9/45 |
| 11,226,168 | B2 * | 1/2022 | Kowalczyk, Jr | F41B 11/54 |
| 11,353,282 | B2 * | 6/2022 | Call | F41B 11/55 |
| 2020/0232749 | A1 * | 7/2020 | Call | F41B 11/55 |

* cited by examiner

PELLET MAGAZINE FOR AIR RIFLES AND PISTOLS

The invention relates to a pellet magazine for compressed air rifles and pistols, of the type comprising an outer casing, inside which a drum is placed having housings for the pellets housing are located; a through hole extending at least partially through its axis of rotation to the drum; a channel through which passes a limit stop for the stroke of the pellets; a joint and an axis around which the drum rotates; characterised in that it comprises: a toothed mechanism arranged in the drum, comprising a series of teeth, tilting means, at least one pawl in contact with at least one of said teeth, and a rotation spring which rotates the drum along the rotation axis, wherein, when in a rest position, the stop prevents rotation of the pellet prepared to be loaded onto the compressed air gun; once the pellet is loaded onto the gun, the pawl locks one of said teeth, and once the pellet is fired and as a consequence of the recoil of the shot, the tilting means moves and releases the tooth pawl, releasing the rotating drum, and the next pellet is blocked by the stop, making the next housing ready to be loaded with a pellet.

BACKGROUND OF THE INVENTION

Different magazines for compressed air rifles or pistols are known in the state of the art.

Thus, state of the art is patent WO2007/057487, "MAGAZINE FOR AIR COMPRESSED GUNS", from the year 2006, in the name of Mr. Eduardo ZORRILLA ARTERO, relates to a magazine for compressed air guns, of the type comprising an essentially cylindrical drum including a plurality of chambers arranged parallel to the axis thereof in circumferential alignment, the chambers designed to receive the corresponding pellets; said drum in turn is of the type that can be replaced the empty one for a full one, in the gun; characterised by the fact that at least one permanent magnet is provided inside said drum which surrounds each and all chambers thereof and generates a magnetic field which attracts all pellets towards said chambers, in order to facilitate the loading of the magazine, for which purpose said pellets are partially or totally made of magnetic material, attracted by said magnet.

Known is also Patent WO2017/125622 "PELLET LOADING SYSTEM", from 2016, in the name of the applicant company, GAMO OUTDOOR, S.L., which relates to a pellet loading system for carbines with break action, comprising a butt on which the chamber is attached, a barrel where the pellet chamber is located, a magazine for pellets and articulation means; characterized in that it comprises: an elastic rod having a central section and two ends that are housed in the chamber, a body where the central section of the elastic rod is position, having forward and backward movement inside said body, and in that it is attached to the barrel; and a propelling means, connected to the elastic rod and positioned between the pellet to be loaded and the elastic rod.

BRIEF DESCRIPTION OF THE INVENTION

The present invention belongs to the field of magazines for air-compressed guns which have a drum where the pellets are stored.

The closest document is the above-cited patent WO2007/057487.

Said patent solves the problem of loading the pellets by using a drum having magnets that attract the pellets.

On the other hand, the disadvantage is that, as indicated in the patent itself, there is the possibility that a "second pellet may tend to get in the chamber already occupied by another pellet."

Said patent intends to avoid that a second pellet may get in the chamber of the pellet and the air-compressed gun may, due to negligence, be shot, with the consequent risk.

Thus, these inventors have developed a new magazine wherein the drum only rotates if an inertial movement occurs, which derives from shooting the gun. Therefore, only when the gun is shot may the inertial movement occur, which will allow rotation of the drum to the next position, where the next available pellet is located.

An object of the present invention is a pellet magazine for air compressed rifles and pistols, of the type comprising an outer casing, inside which a drum is placed having housings where the pellets are located; a through hole extending at least partially through its axis of rotation to the drum; a channel through which passes a limit stop for the stroke of the pellets; a joint and an axis around which the drum rotates; characterised in that it comprises: a toothed mechanism arranged in the drum, comprising a series of teeth, tilting means, at least one pawl in contact with at least one of said teeth, and a rotation spring which rotates the drum along the rotation axis, wherein, when in a rest position, the stop prevents rotation of the pellet prepared to be loaded onto the compressed air gun; once the pellet is loaded onto the gun, the pawl locks one of said teeth, and once the pellet is fired and as a consequence of the recoil of the shot, the tilting means moves and releases the tooth pawl, releasing the rotating drum, and the next pellet is blocked by the stop, making the next housing ready to be loaded with a pellet.

BRIEF DESCRIPTION OF THE DRAWINGS

In order to facilitate the explanation hereof, fifteen sheets with drawings are attached to this description, in which one practical embodiment is represented, provided by way of example and not limiting the scope of the present invention.

PRACTICAL EMBODIMENT OF THE PRESENT INVENTION

Figure 1:
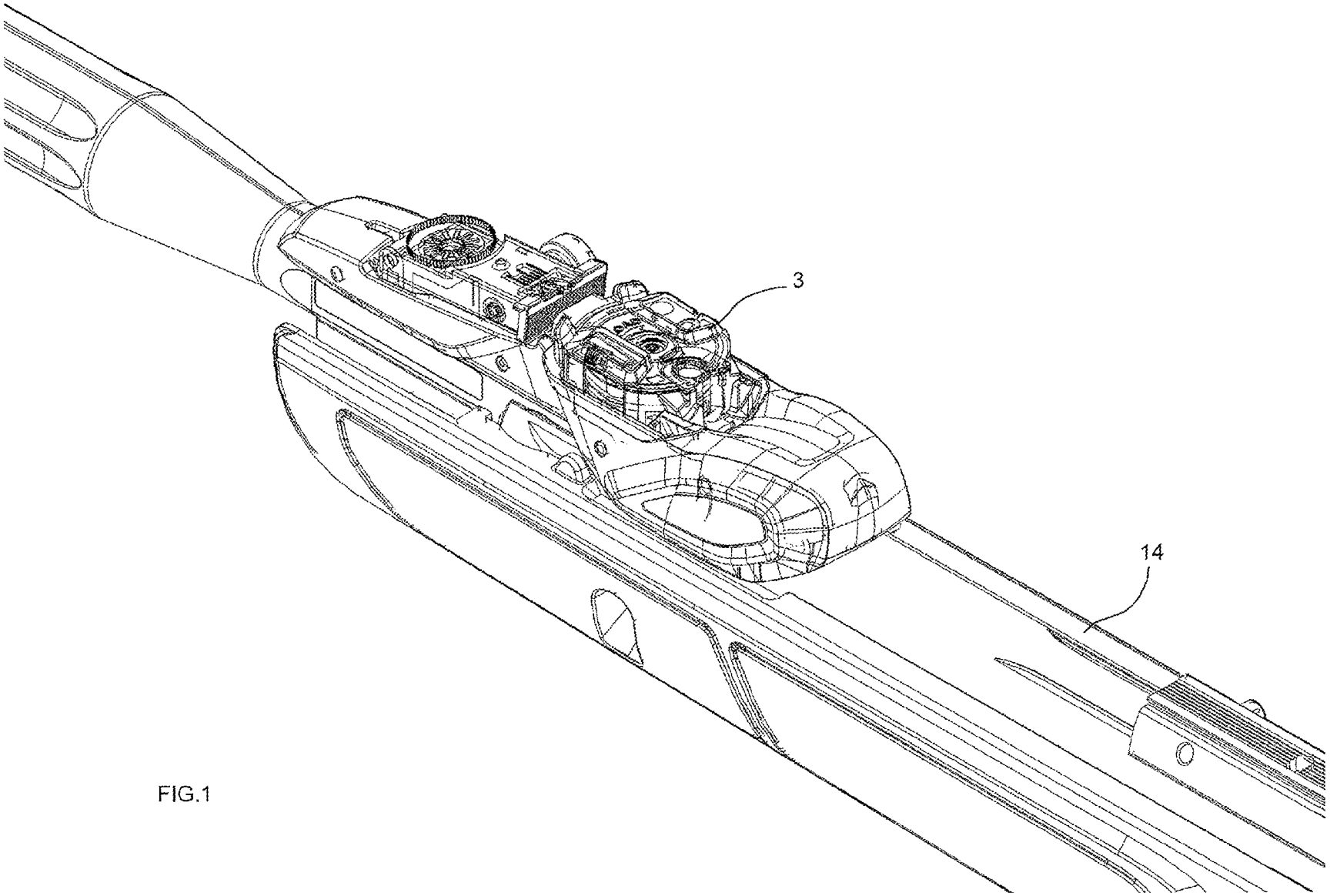
FIG. 1 is a partial view of a rifle with a magazine arranged horizontally.

Thus, FIG. 1 illustrates a rifle 14 and a magazine 3.

Figure 2:
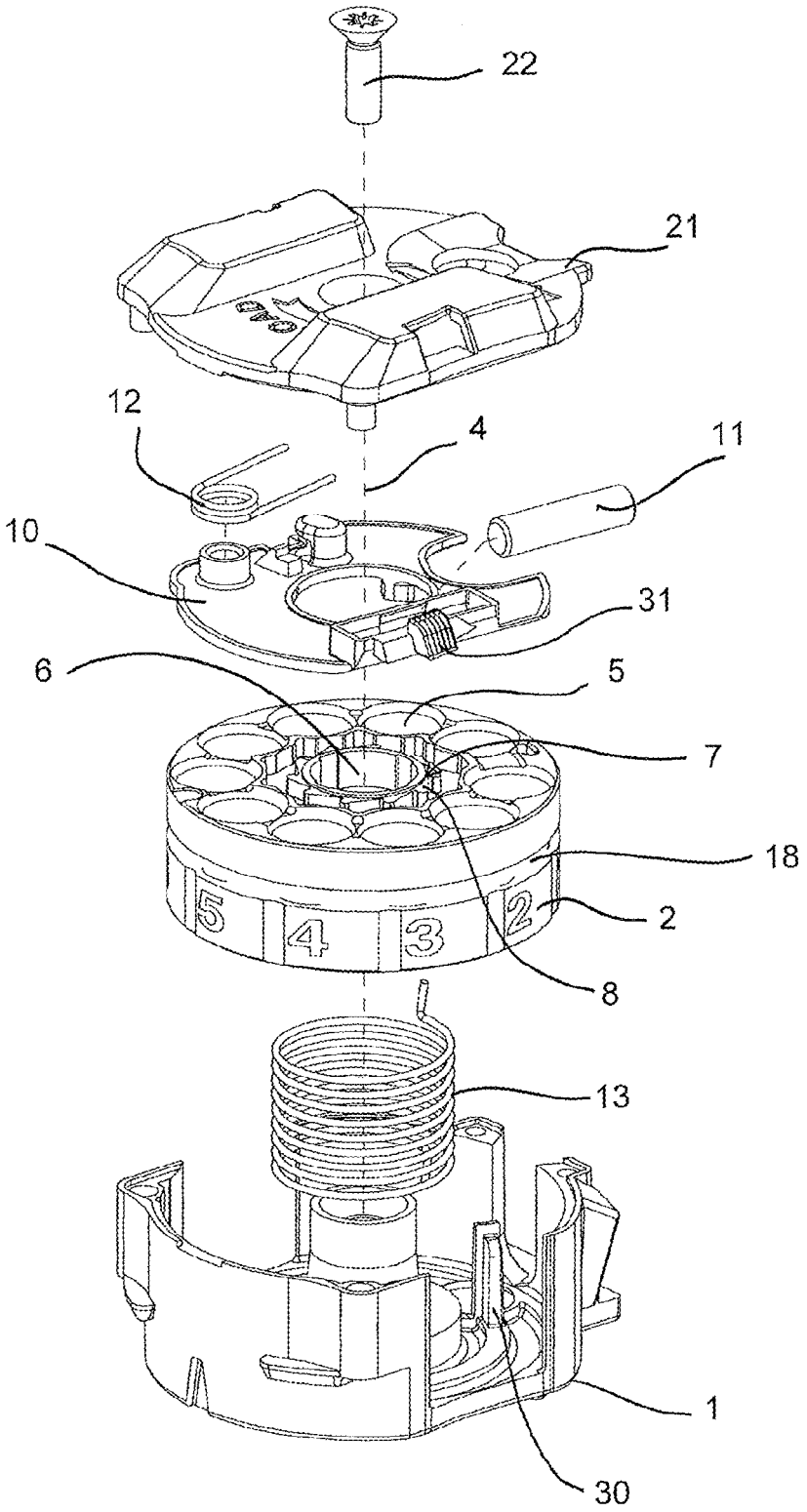
FIG. 2 is an exploded view of the magazine of FIG. 1.

FIG. 2 illustrates an outer casing 1, a drum 2 having a joint 18, a housing 5, a through hole 6, a rotation axis 4, a toothed mechanism 7, teeth 8, a tilting plate 10, a push button 31, tilting means consisting of an inertia mass 11 and a spring 12, a rotation spring 13, a limit stop 30, a lid 21 and a screw 22.

Figure 3:
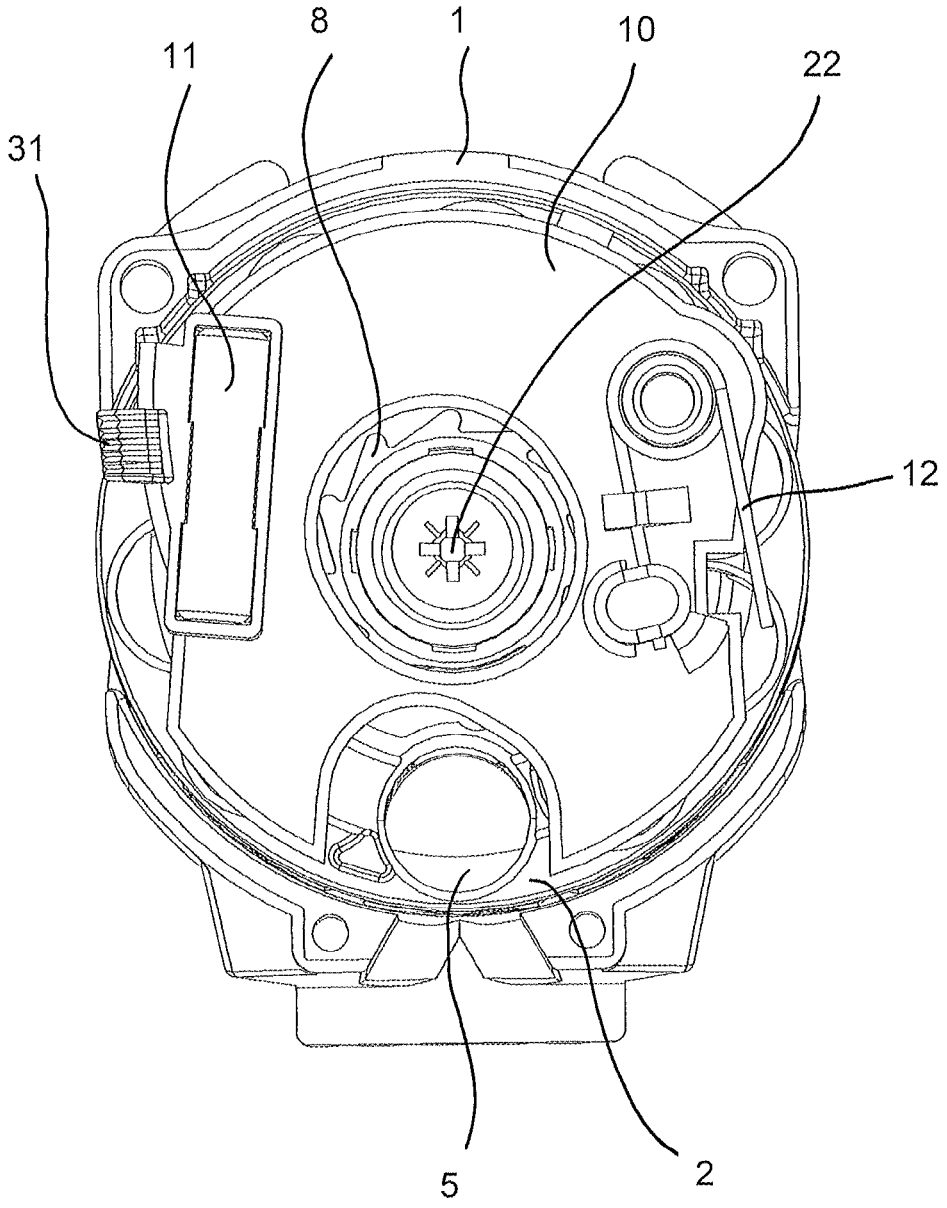
FIG. 3 is a plan vies of the magazine of FIG. 1 without the lid.

FIG. 3 shows the outer casing 1, the drum 2, the housings 5, the teeth 8, the tilting plate 10, the inertia mass 11, the spring 12, the push button 31 and the screw 22.

Figure 4:
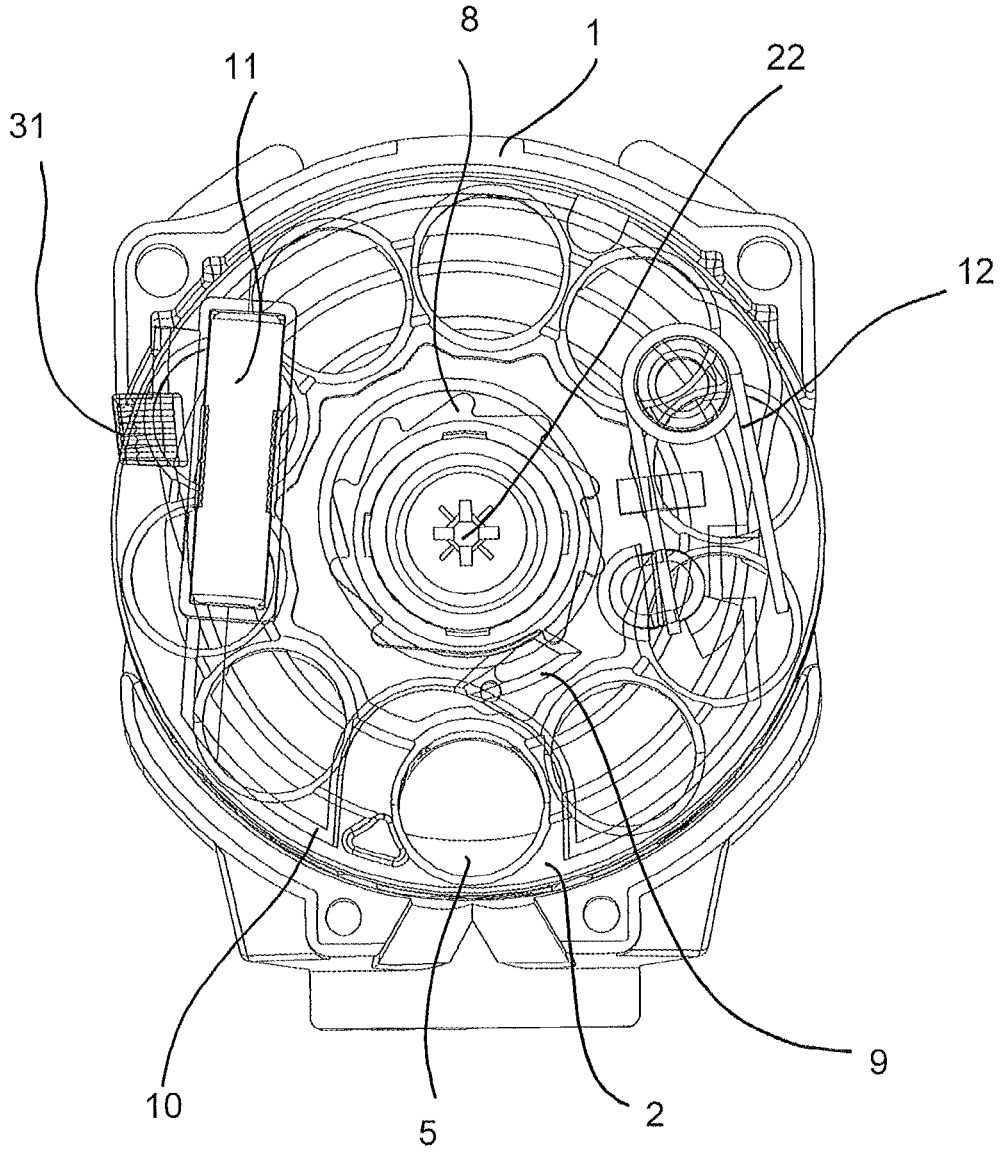
FIG. 4 is a view of FIG. 3, in which the tilting plate has been made transparent.

FIG. 4 shows the outer casing 1, the drum 2, the housings 5, the teeth 8, a pawl 9, the tilting plate 10, the push button 31, the inertia mass 11, the spring 12 y the screw 22.

Figure 5:
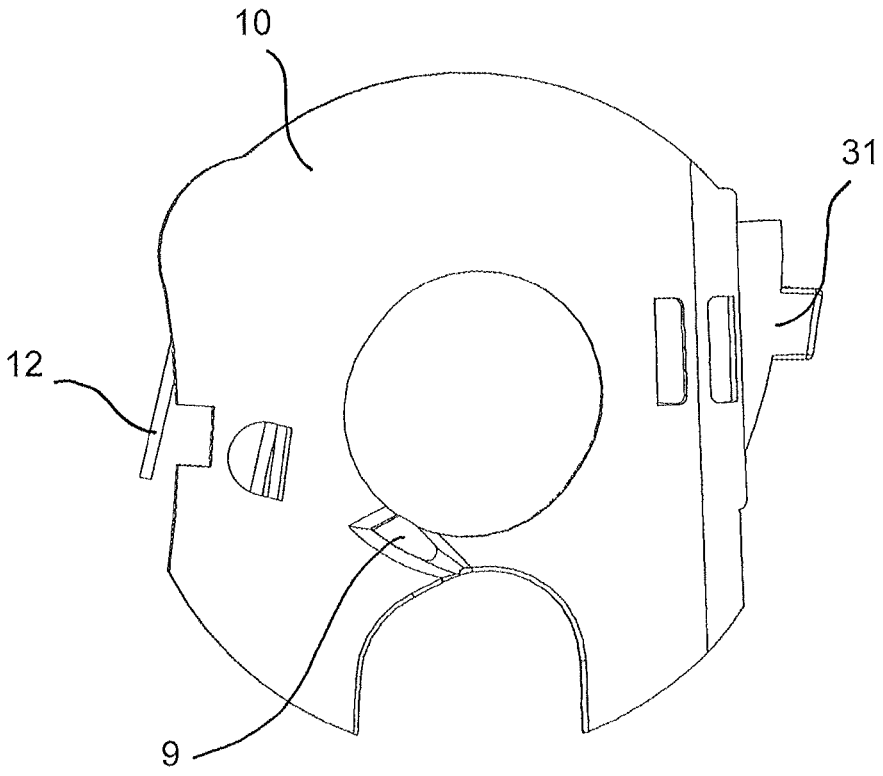
FIG. 5 is a bottom view of the tilting plate.

FIG. 5 illustrates the pawl 9, the tilting plate 10, the push button 31 and the spring 12.

Figure 6:
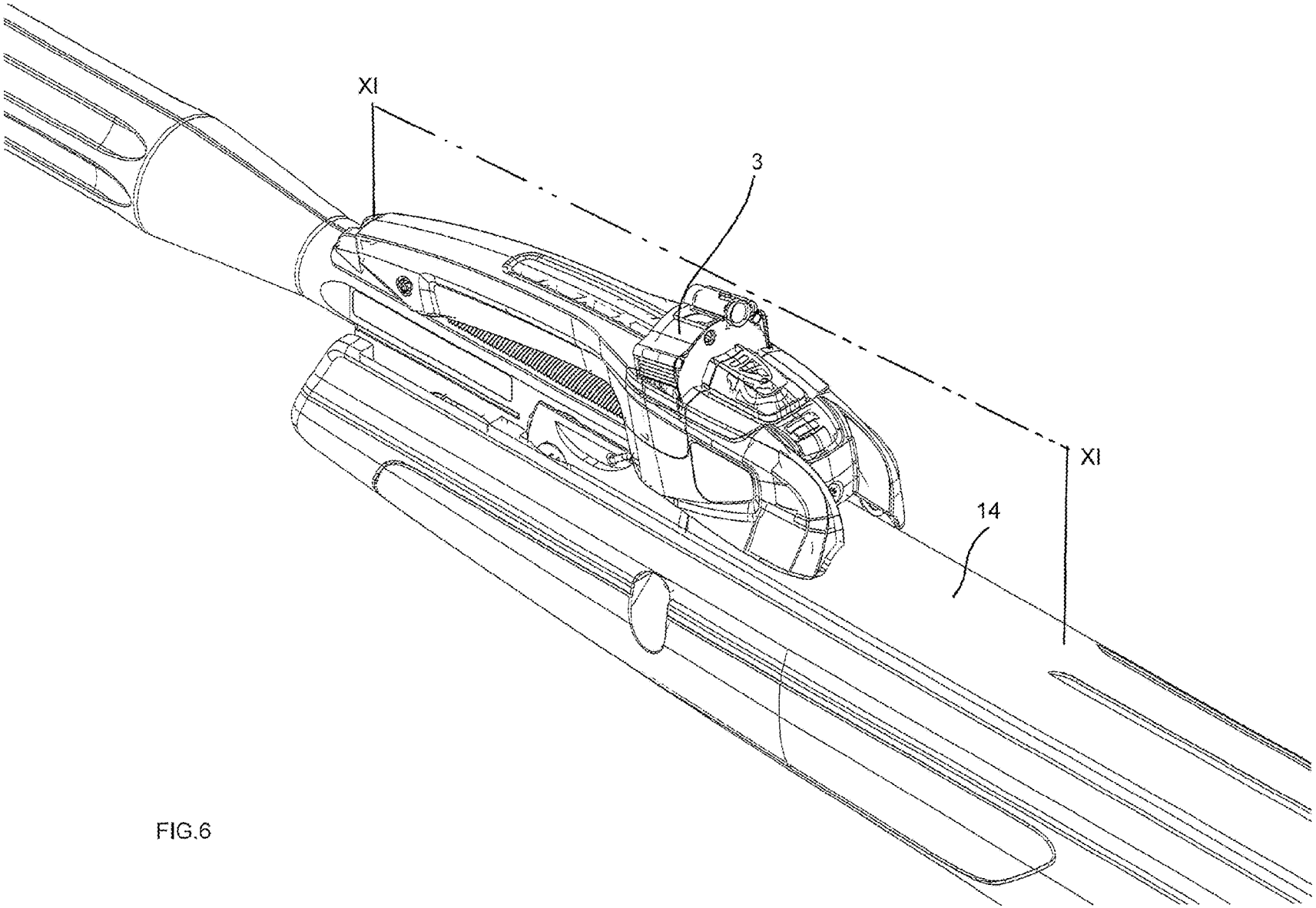
FIG. 6 is a partial view of a rifle with a magazine shown vertically.

FIG. 6 shows the rifle 14 and the magazine 3.

Figure 7:
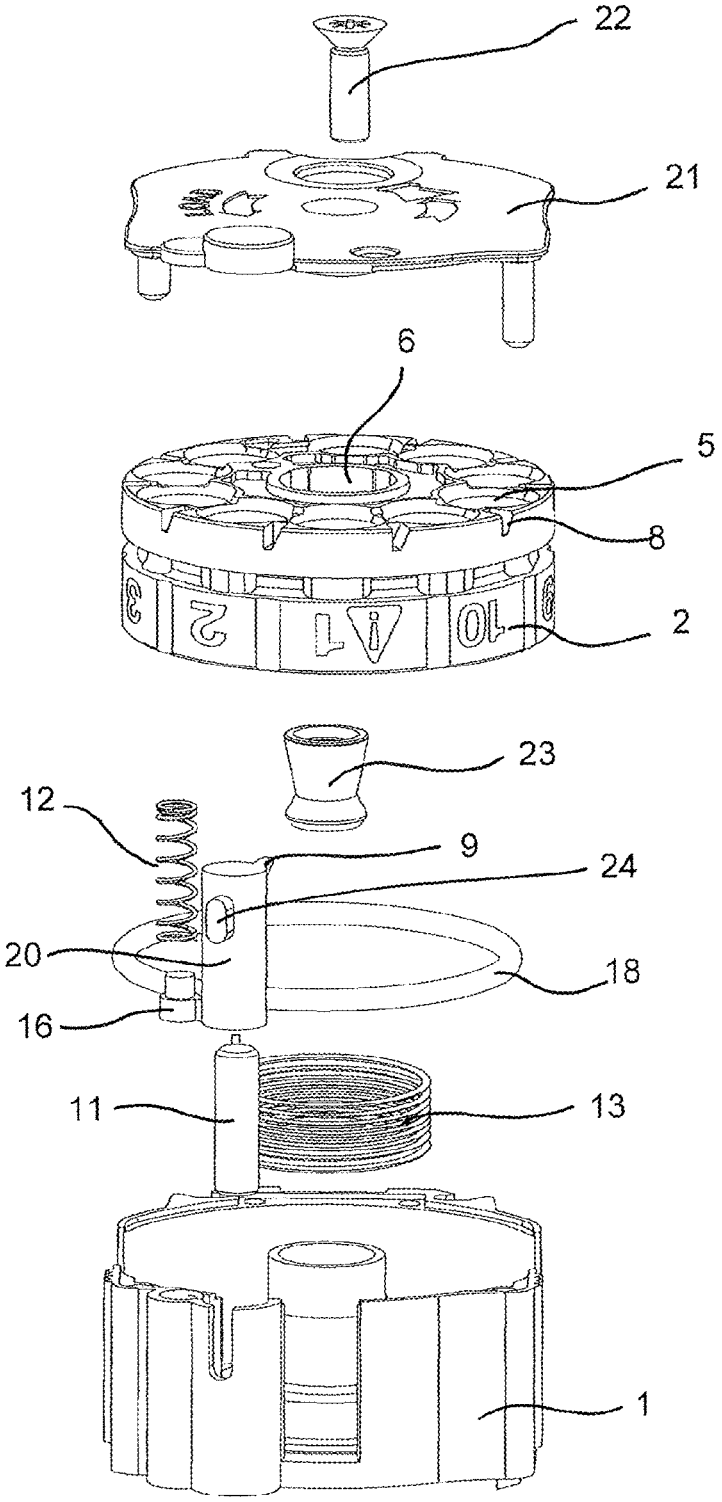
FIG. 7 is an exploded view of the magazine of FIG. 6.

FIG. 7 shows the outer casing 1, the drum 2, the housings 5, the through hole 6, the teeth 8, the joint 18, the inertia mass 11, the spring 12, the rotation spring 13, an inertia body 20 with its extension 16, its push button 24 and the pawl 9, the lid 21, a pellet 23 and the screw 22.

Figure 8:
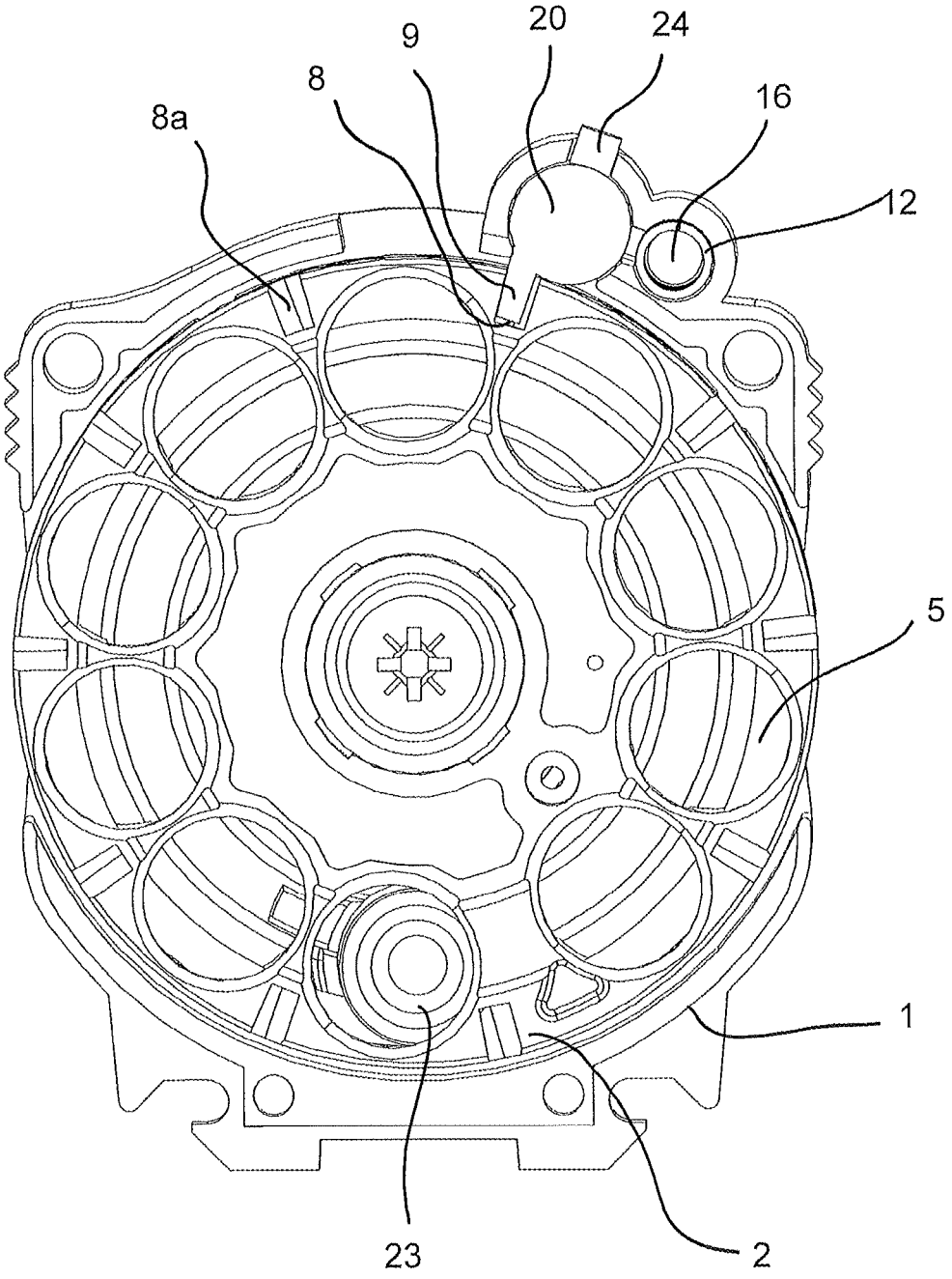
FIG. 8 is a plan view of the magazine of FIG. 6 without the lid.

FIG. 8 illustrates the outer casing 1, the drum 2, the housings 5, the teeth 8, 8*a*, the spring 12, the inertial body 20 with its extension 16, its push button 24 and the pawl 9 and the pellet 23.

Figure 9:
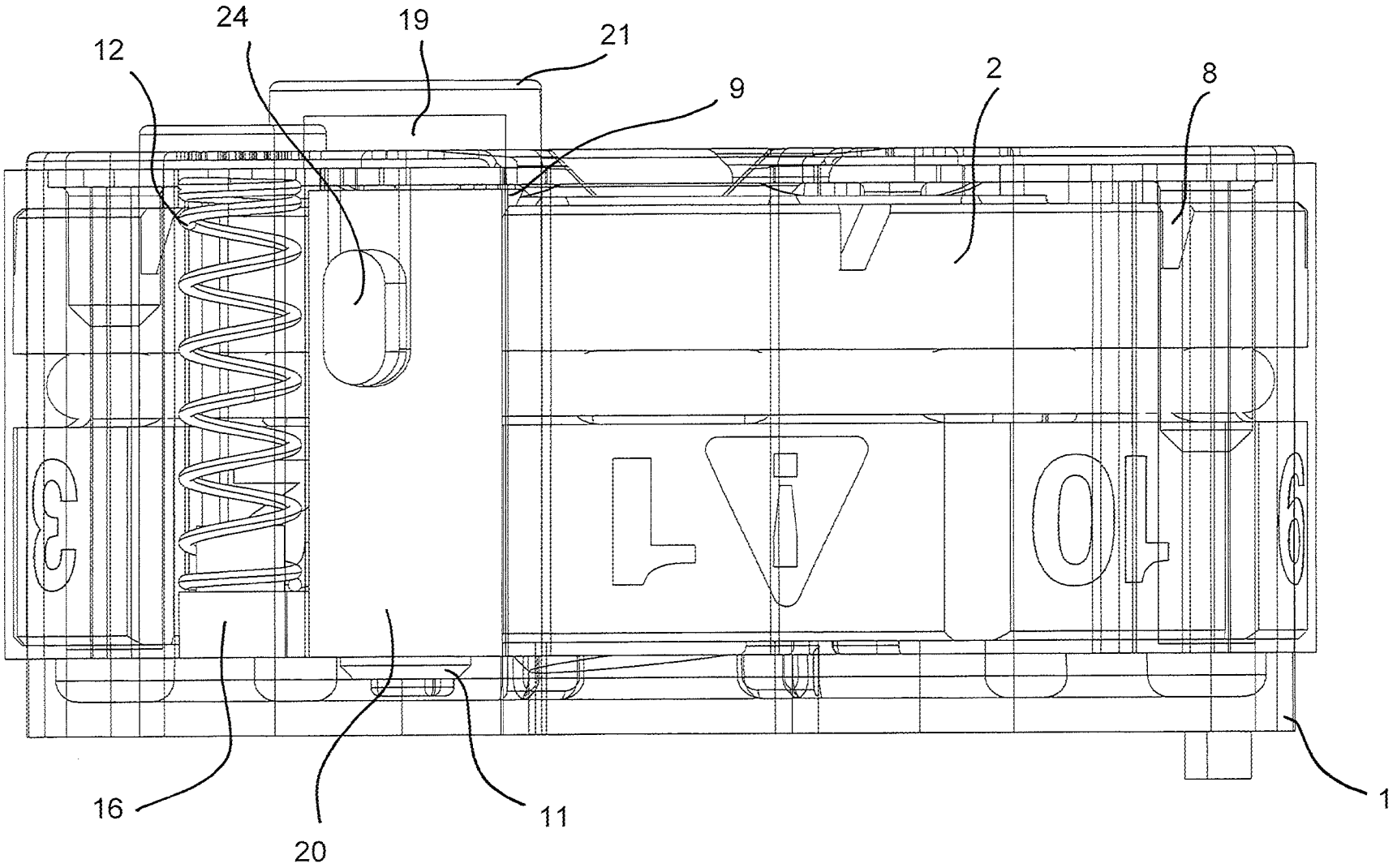
FIG. 9 is a lateral view of the magazine of FIG. 6 with the external case being made transparent.

FIG. 9 illustrates the outer casing 1, the drum 2, the teeth 8, the inertia mass 11, the spring 12, the inertial body 20 with its extension 16, its push button 24 and the pawl 9, a predetermined space 20 and the lid 21.

Figure 10:
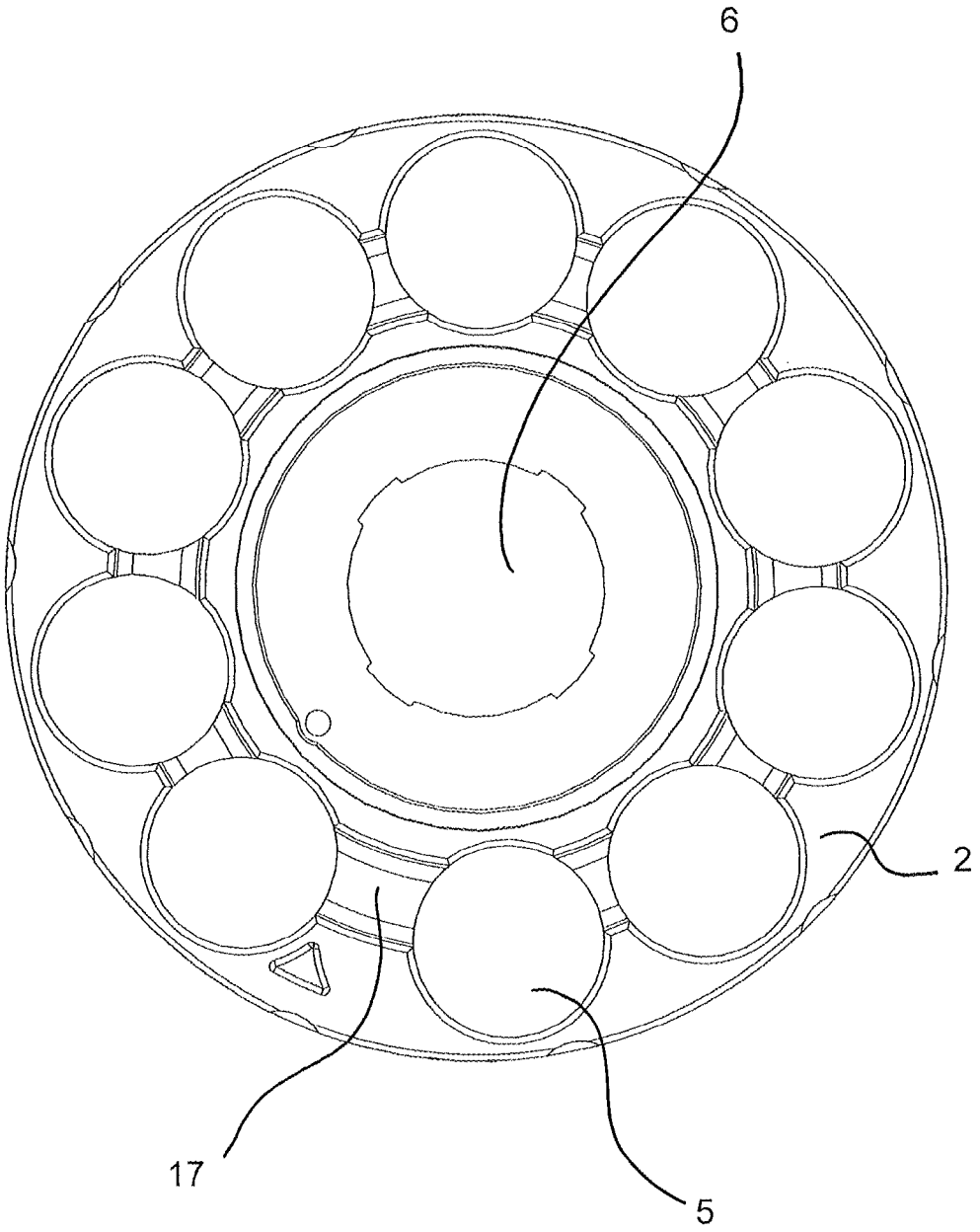
FIG. 10 is a bottom view of the drum.

FIG. 10 has illustrated the drum 2, the housings 5, the through hole 6 and a channel 17.

Figure 11:
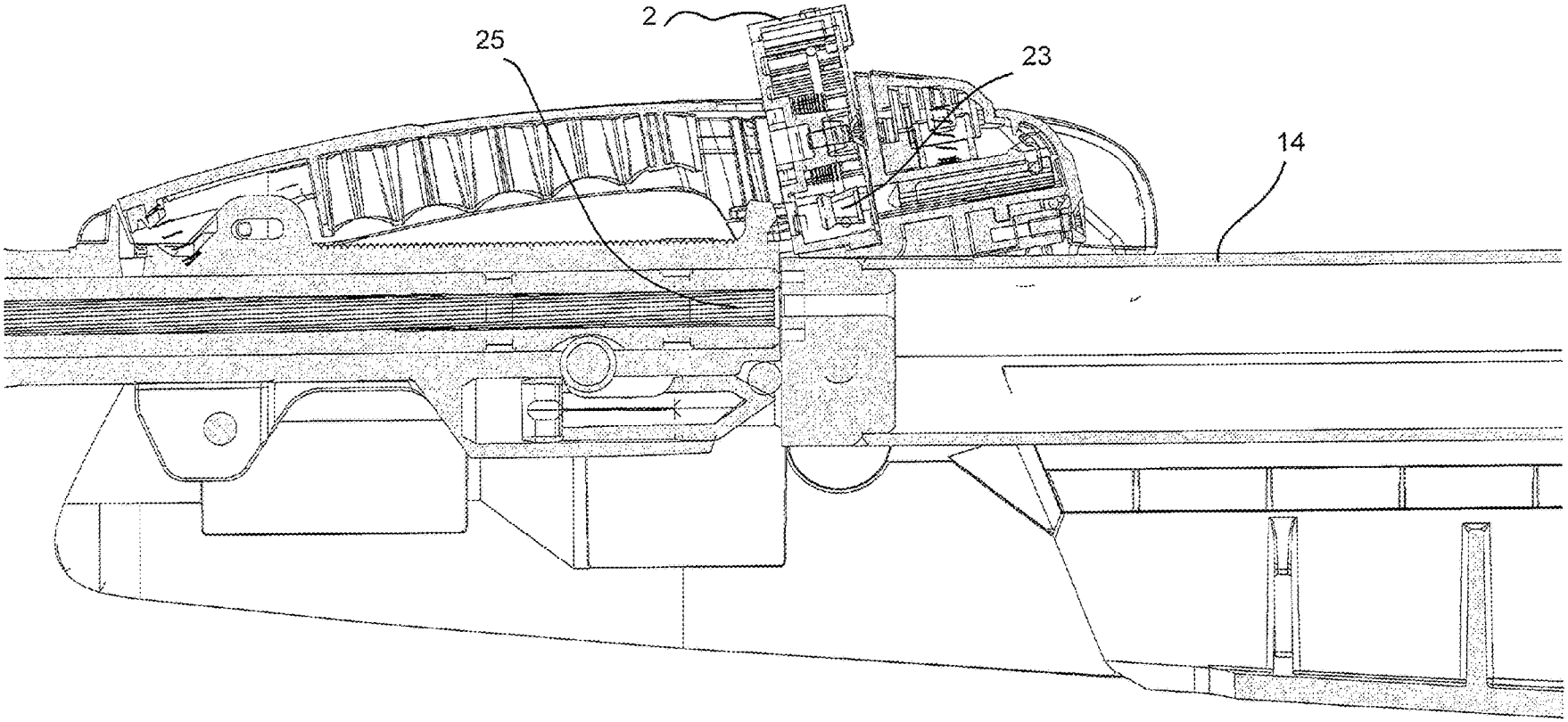
FIG. 11 is a section cut by line XI-XI of FIG. 6.

FIG. 11 shows an air compressed rifle 14, the pellet 23, the drum 2 and a pellet chamber 25. This last FIG. 11 has been included only to facilitate the understanding of where the pellet chamber 25 is located.

Figure 12:
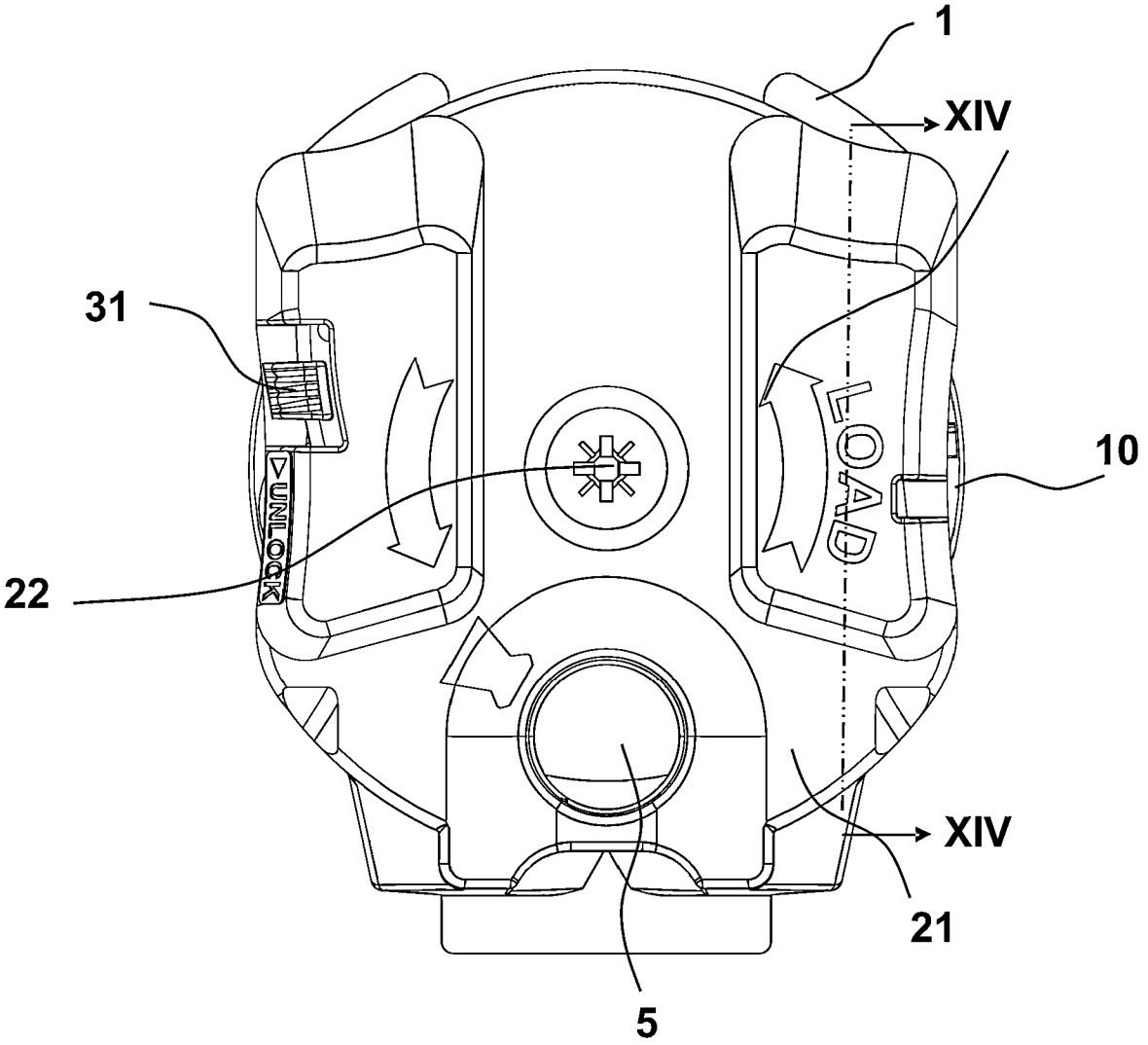
FIG. 12 is an elevation view of a variant of the magazine of FIG. 1.

FIG. 12 shows the outer casing 1, the housing 5, the tilting plate 10, the push button 31, the lid 21 and the screw 22.

FIGS. 13*a*-13*e* illustrate the tilting plate 10, the housing 5, the tooth 8, the pawl 9, the spring 12, a slot 50 and a rotation axis 51.

Figure 14:
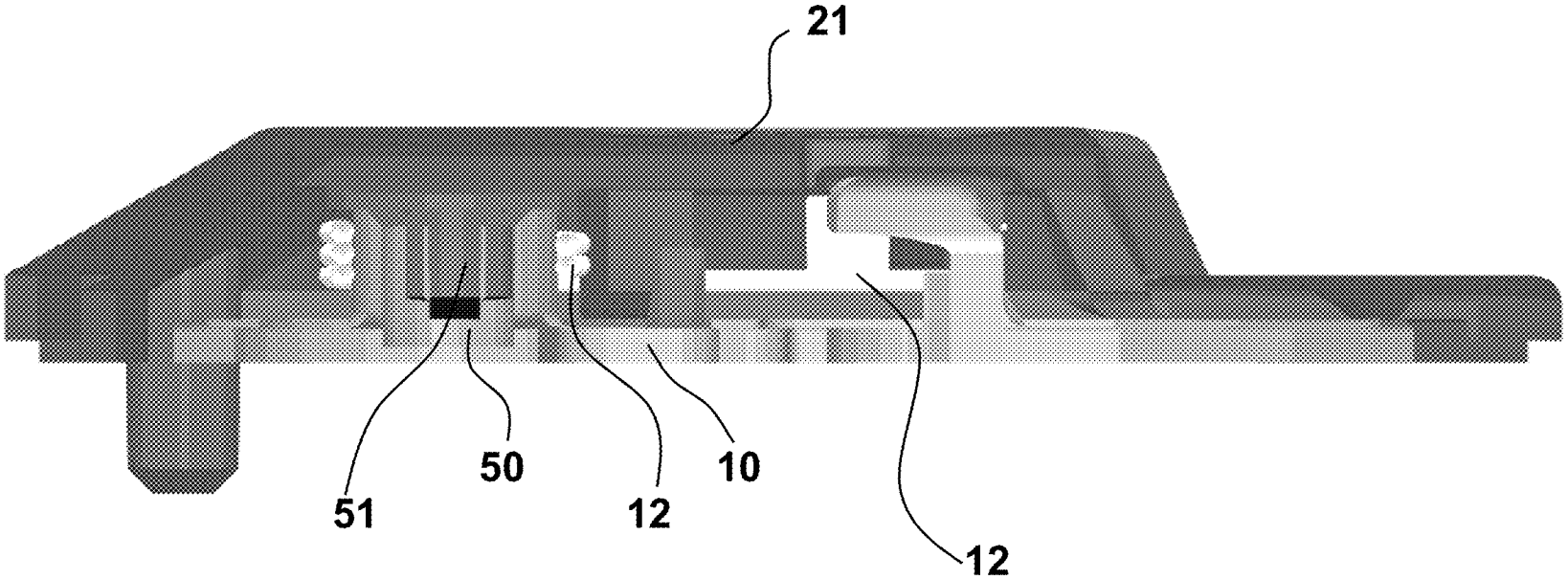
FIG. 14 is a sectional view along the lines XIV-XIV of FIG. 12.

Last, FIG. 14 shows the lid 21 with the rotation axis 51, the spring 12, the tilting plate 10 with its slot 50.

For clarity purposes, the pellet 23 is not shown in all figures, although it should be understood that the pellet is a visible or an invisible part of all the figures.

Thus, the device of the present invention consists of an outer casing 1, in which interior is a drum 2. The drum includes a number of housings 5 where the pellets are housed 3.

Comprised is a through hole 6 that passes, at least partially (it could be a blind hole), through its rotation axis to the drum rotation axis to the drum 2. The drum 2 rotates around a rotation axis 4.

Likewise, in the drum 2 a channel 17 (FIG. 10) is provided whereby a limit stop 30 passes, which is the end of the stroke of the pellets 23, and an elastic joint 18, which holds and repositions the pellets 23 in the housings 5.

In addition, a toothed mechanism 7 is arranged in the drum 2, which is provided with a series of teeth 8 where the pawl 9 will be engaged, as it will be explained hereafter.

In addition, there are tilting means 11, 12, an inertia mass and a spring 12.

Thus, the device comprises at least a pawl 9, which, in this embodiment, in order to facilitate the understanding, is just one pawl 9. For tolerance reasons, the pawl 9 may be not in contact with the tooth 8 until the pellet 23 has been loaded onto the pellet chamber 25 of the air compressed gun 14.

In the case in which the calculations have been adjusted, the pawl 9 will be in contact with at least one of said teeth 8, blocking the drum 2 as from the moment when the pellet 23 is blocked by the limit stop 30, in a synchronised manner.

Likewise, the device is provided with a rotation spring 13 which rotates the drum 2 on the rotation axis 4.

In this manner, when in a resting position, the limit stop 30 prevents the rotation of the pellet 23 and consequently of the drum 2. The pellet 23 is then prepared to be housed in the pellet chamber 25, for example, in the same manner as it has been described in the Applicant's patent WO2017/125622.

Once the pellet 23 is housed inside the pellet chamber 25 of the air compressed gun 14, the limit stop 30 stops preventing the drum 2 from rotating and as soon as the drum 2 slightly moves, the pawl 9 blocks one of said teeth 8, preventing the rotation of the drum 2.

If the user cannot remember if they have or have not loaded a pellet 23 onto the pellet chamber 25, even if they would carry out the manoeuvre, no pellet 23 would be loaded because in the housing 5 that is facing the pellet chamber 25 there are no pellets 23, since the pellet 23 is inside the pellet chamber 25 and the drum 2 does not rotate in order to facilitate a new pellet.

Consequently, with this invention, the loading of two or more pellets 23 inside the pellet chamber 25 is prevented, which the nearest document could not achieve, as explained in its very description.

Once the pellet inside the pellet chamber 25 is fired, the tilting means 11, 12 move by the effect of the recoil of the shooting and release the pawl 9 of the teeth 8, likewise releasing the drum 2 which rotates, stopping the following pellet 23 when its passing is blocked by the stop limit 30.

In addition, the tilting means 11, 12 go back to their initial position.

The toothed mechanism 7 optionally may be a ratchet type mechanism, having saw-like teeth 8.

Unlike the nearest document, in this case the ratchet type mechanism serves as a block when there is no longer ammunition, whereas in the nearest document it served to let the drum go forward and prepare the following ammunition.

Optionally, the teeth 8 are located around the through hole 6.

In one of the embodiments, the magazine 3 comprises a tilting plate 10 wherein the tilting means 11, 12 and the pawl 9 are positioned (FIGS. 2-5).

The tilting means comprise an inertia mass 11 which makes the tilting plate rotate by the effect of the inertia produced by the shooting (at the time of recoiling).

When the tilting plate 10 rotates, the tooth 8 will be released and will rotate the drum 2 by the action of the rotation spring 13.

Then, the spring 12 rotates the tilting plate 10 in the opposite direction until it reaches the initial position, that is, with the pellet 23 being blocked by the limit stop 30.

In the embodiment as per FIGS. 1-5, the inertia mass 11 is positioned perpendicularly to the housings 5.

The tilting means may comprise a push button 31, connected to the tilting plate 10. If said push button 31 is actuated, it pushes the tilting plate 10, in order to enable unloading the pellet magazine.

If upon ending the use of the gun, a number of pellets would still remain inside the magazine 3, the user would not be able to recover such pellets because, without the inertial movement, the pawl 9 blocks the drum 2.

When the push button 31 is pressed, the tilting plate 10 moves and withdraws the pawl 9 from the teeth 8, thus allowing the rotation of the drum 2. Consequently, when the next pellet 23 rotates, it will be stopped by the limit stop 30 and thus the user will be allowed to extract the pellet manually, and similarly with the rest of the pellets remaining inside the drum 2.

The inventors have observed that, at times, users use or substitute accessories that modify the total weight of the carabine, which causes that the carabine or pistol modifies the recoil upon shooting, and this could affect the movement of the tilting plate 10.

This causes that, when shooting, the tilting plate 10 moves and releases the pawl 9 (which is attached to the tilting plate 10) connected to tooth 8, but the tilting plate moves fast enough to regain the initial position, blocking again the pawl 9 to the same tooth 8 before the drum 2 has been able to rotate. This is so because the drum 2 has to drag the pellets that are stored within the drum 2 and therefore the drum 2 takes more time to rotate than the time that the tilting plate 10 takes to go back to the initial position.

If the carabine is calibrated, this problem does not occur. However, the problem occurs when the carabine is no longer calibrated due to the addition or removal of accessories.

Figure 13C:
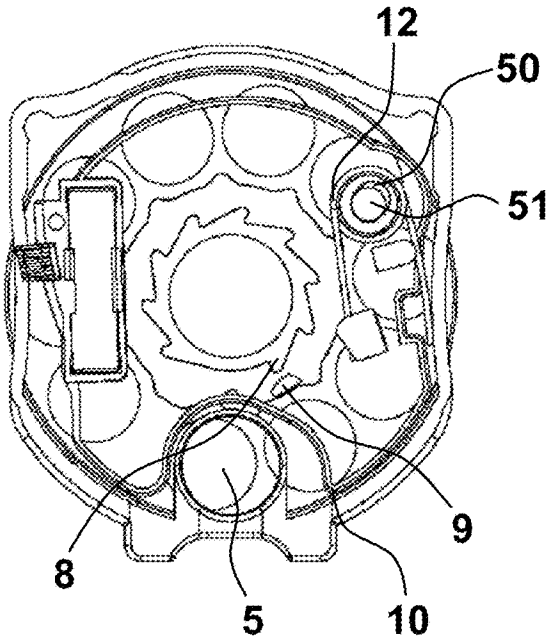
FIG. 13*a*-13*e* are partial views without the lid and with a transparent tilting plate, of the movement stages from shot to pellet loading.
Figure 13B:
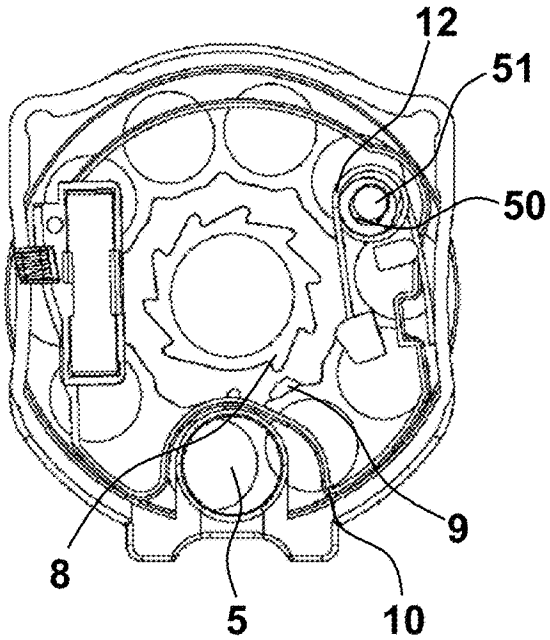
Figure 13A:
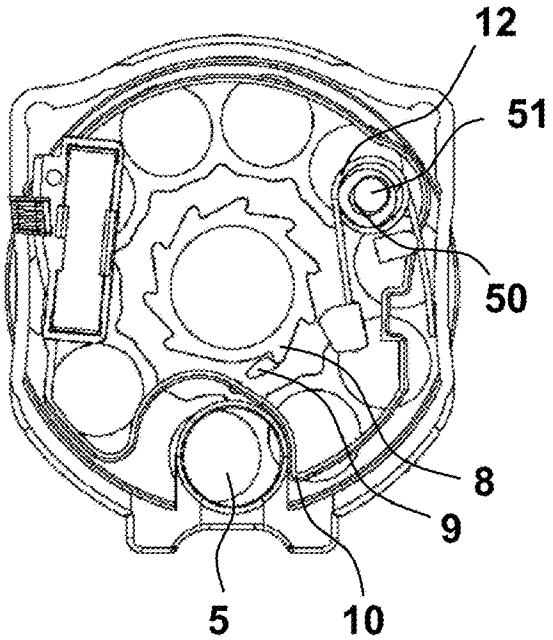
Figure 13E:
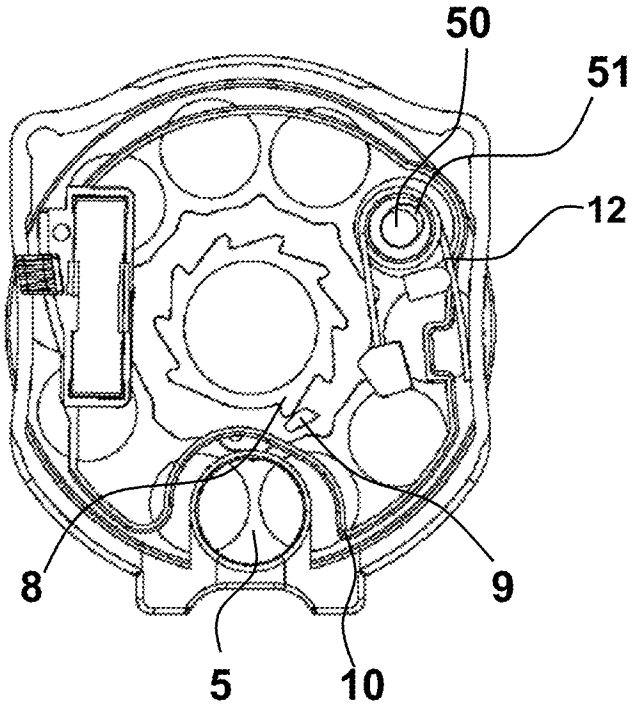

Consequently, the inventors have optionally introduced the possibility of increasing the time for returning to the initial position by delaying the time that the tilting plate 10 takes to recover the initial position (FIG. 13*a*).

Thus, as indicated in the example of FIG. 2, the tilting means comprise an inertia mass 11 that causes the tilting plate 10 to rotate and move by the effect of the inertia of the shot, thereat releasing the tooth 8 and causing the drum 2 to rotate. In addition, the tilting means comprise a spring 12 connected to a slot 50 positioned in the tilting plate 10. Inside the slot 50 there is a rotation axis 51, such rotation axis 51 of the tilting plate 10 being positioned at one end of the slot 50 when the pawl 9 blocks one of the teeth 8 and the rotation axis 51 being on the other end of the slot 50 when the pawl 9 releases the tooth 8.

Optionally in this embodiment, the slot 50 is oriented towards the central region of the tilting plate 10, determining that the tilting plate 10 moves from bottom to top and vice versa.

As a manufacturing option, it is provided that the outer casing 1 be closed by a lid 21, being said rotation axis 51 integral with said lid 21. In this manner, the lid 21, which is attached to the outer casing 1 by the screw 22, the rotation axis 51 does not move and it is the shot inertia mass 11 which causes the tilting plate 10 to move, and the movement of the tilting plate 10 is directed by the slot 50, inside which is the rotation axis 51.

In other embodiments, the teeth 8 are arranged outside the drum 2 (FIGS. 7-11).

In addition, the tilting means comprise an inertia mass 11 which pushes an inertial body 20 which ends up at a pawl 9, pushing such inertial body 20 against a lid 21 of the magazine 3, such lid being initially separated from said inertial body 11 at a predetermined spacing 19, by the effect of the shooting inertia.

This causes the release of the tooth 8, rotating the drum 2.

Next, the spring 12 resting on the lid 21 pushes the inertial body 20 in the opposite direction, blocking the pawl 9 at the following tooth 8*a* and separates again the inertial body 20 from the lid 21 at the cited predetermined spacing 19.

Said predetermined spacing 19 is greater than the height of the pawl 9, that is, the pawl 9 should have space enough to unlock the tooth 8 and to be able to unlock the following tooth 8*a*.

In this embodiment, in order to reduce the space, the inertia mass 11 is positioned within the inertial body 20, so that, when the recoil occurs after shooting, the inertia mass 11 pushes the inertial body 20 against the lid 21.

The inertial body 20 may comprise an extension 16 which pushes the spring 12 against the lid 21 when the inertia mass 11 pushes the inertial body 20.

Likewise, when the spring 12 expands, it pushes the extension 16, which, being connected to the inertial body 20, causes the inertial body 20 to equally move to its initial position.

The inertia mass 11 is positioned perpendicularly to the housings 5 in order to facilitate the release of the pawl 9 when the magazine is arranged vertically.

Likewise, in the case where the magazine is arranged horizontally, as explained above, this embodiment also comprises a push button 24 which, when actuated, releases the pawl 9 and unlocks tooth 8.

That is, to let the pellets 23 out of the magazine 3, action should be exerted on the push button 24 towards the lid 21, thus releasing the pawl 9 of the tooth 8, allowing the rotation of the drum 2 and letting the next pellet reach the limit stop 30. Said pellet 23 may be extracted manually and the same operation may be carried out with the following pellets, until emptying the magazine 3.

In this way, if the magazine 3 is of the horizontal type, as in FIGS. 1 to 5, the operation would be the following:

The magazine 3 would be inserted in the air compressed rifle 14, also known in English as "air rifle", although it could also be an air compressed pistol.

Then the rifle 14 would be broken down and the pellet 23 would be introduced inside the pellet chamber 25, for example, in the manner described in patent WO2017/125622 of the same Applicant.

Once the pellet 23 has been introduced inside the pellet chamber 25, the pawl 9 blocks the tooth 8 and prevents the drum 2 from rotating.

If the user wishes to load another pellet 23, they would be prevented from doing this, since there would be no pellets in the housing 5 because the drum 2 will not have rotated.

After the user fires the rifle 14 and the rifle 14 recoils, and inertial movement occurs which causes the inertia mass 11 to move backwards and rotate the tilting plate 10, which, being linked to the pawl 9, moves the pawl 9 and releases the tooth 8, thus allowing the drum 2 to rotate.

The drum 2 rotates until the next pellet 23 finds the limit stop 30 and stops, and the pellet 23 is thus prepared for the user if they decide to reload the rifle 14.

In the variant of FIG. 13 and ss, before the shot takes place, the pawl 9 is blocking the tooth 8, thus preventing the rotation of the drum 2. The drum 2 exerts a force on the tilting plate 10, moving the slot 50 which is integral with the tilting plate 10 until it reaches the rotating axis 51 (FIG. 13*a*).

Next, when the user shoots, the pawl 9 releases the tooth 8, thus allowing the drum 2 to rotate. In addition, the drum 2 stops exerting a force on the tilting plate 10 and thus allows the tilting plate 10 to rotate by the rotating axis 51 and by the effect of the spring 12 (FIG. 13*b*). It should be mentioned that at this point in time the drum 2 has not yet moved.

Figure 13D:
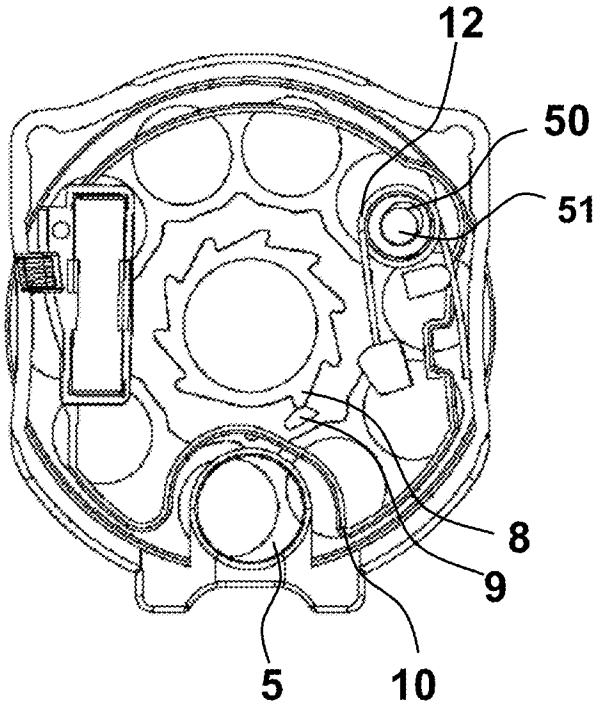

Next, the spring 12 causes the tilting plate 10 to move along the slot 50 thanks to the rotating axis 51 (FIG. 13*c*). This movement along the slot 50 prevents the pawl 9 from reengaging the tooth 8 in the same position as when the rotation of the tilting plate 10 starts rotation by the effect of the spring 12 (FIG. 13*d*). The drum 2 has not yet moved but it starts the movement just after this, when FIG. 13*d* ends and before FIG. 13*e* begins.

Last, the drum 2 can in this manner move forward to the next pellet because the pawl 9 is no longer blocking the same tooth 8 but it will immediately block the following tooth (FIG. 13*e*) and give way to the following housing 5 with a new pellet. This allows that even when the user has disbalanced the carabine or pistol by introducing or removing accessories, the drum 2 will continue to rotate until the following pellet (FIG. 13*a*) is if it were a calibrated carabine or pistol.

In the case of the vertical magazine, as illustrated in FIGS. 7-9 and 11, the procedure would be substantially the same as above, with some differences due to the adaptation of the tilting means from a horizontal position to a vertical one.

Thus, the loading of the pellet 23 is substantially the same to the explanations regarding the magazine 3 in a horizontal position, as described in patent WO2017/125622 of the same applicant.

Likewise, when the pellet 23 is inside the pellet chamber 25, the pawl 9 is positioned in tooth 8, so that the drum 2 is prevented from rotating and therefore a new pellet 23 may not be placed nor prepared to be loaded in the pellet chamber 25.

When the shooting and the recoil take place in the rifle 14, the inertia mass 11 pushes the inertial body 20 against the lid 21, releasing the pawl 9 from inside the tooth 8, which occupies the predetermined space 20, allowing the drum 2 to rotate and a new pellet 23 to be blocked by the limit stop 30, being positioned to be loaded.

At the same time that the inertia mass 11 pushes the inertial body 20, the extension 16 which is linked to the inertial body 20 pushes the spring 12 against the lid 21 and when the spring 12 is decompressed, it pushes the extension 16, which drags the inertial body 20 and positions the pawl in the new tooth, blocking again the drum 2.

The present invention describes a new pellet magazine for air compressed rifle and pistol. The examples mentioned herein are not limiting of the present invention, therefore it may have different applications and/or adaptations, all of them within the scope of the following claims.

The invention claimed is:

1. A pellet magazine for air compressed guns including rifles and pistols, comprising:

an outer casing; and a drum disposed in the outer casing, the drum including:

housings to receive pellets therein;

a through hole extending at least partially through an axis of rotation of the drum;

a channel through which passes a limit stop for a stroke of the pellets;

a joint and an axis around which the drum rotates;

a toothed mechanism arranged inside the drum and including a series of teeth (8);

tilting means configured to move by a recoil action after shooting a pellet and to release the drum to rotate until a next pellet is blocked by the limit stop;

at least one pawl in contact with at least one of the teeth, and a rotation spring which rotates the drum around the rotation axis, wherein, when in a rest position, the limit stop prevents rotation of a pellet prepared to be loaded onto an air compressed gun; once a pellet is loaded into a housing of the drum, the pawl blocks one of said teeth, and once the pellet is fired and as a recoil takes place in the air compressed gun, the tilting means move and release the pawl from the teeth, thus releasing the drum, which then rotates, and a next pellet is blocked by the limit stop, making a next housing ready to be loaded with a pellet.

2. A pellet magazine according to claim 1, wherein the pawl blocks one of the teeth at a same time that the limit stop prevents rotation of the pellet.

3. A pellet magazine according to claim 2, wherein the toothed mechanism is a ratchet mechanism having teeth.

4. A pellet magazine according to claim 2, wherein the teeth are positioned outside the drum.

5. A pellet magazine according to claim 4, wherein the tilting means comprise an inertia mass which pushes an inertial body which ends at a pawl and pushes it against a lid of the magazine, which lid is initially separated from the inertial body at a predetermined spacing, by an effect of an inertia of shooting a pellet, thus releasing the tooth and rotating the drum, and a spring which rests on the lid pushes the inertial body in an opposite direction, blocking also the pawl to a following tooth and separating the new inertial body from the lid at the predetermined spacing.

6. A pellet magazine according to claim 5, wherein the predetermined spacing is larger than a height of the pawl.

7. A pellet magazine according to claim 6, wherein the inertia mass is located inside an inertial body.

8. A pellet magazine according to claim 7, wherein the inertial body comprises an extension which pushes the spring against the lid when the inertia mass pushes the inertial body.

9. A pellet magazine according to claim 8, wherein the inertia mass is positioned parallel to the housings of the pellets.

10. A pellet magazine according to claim 9, further comprising a push button which, when actuated, releases the pawl and releases the tooth.

11. A pellet magazine according to claim 1, wherein the toothed mechanism is a ratchet mechanism having teeth.

12. A pellet magazine according to claim 11, wherein the teeth are positioned around the through hole.

13. A pellet magazine according to claim 12, further comprising a tilting plate wherein the tilting means and the pawl are positioned.

14. A pellet magazine according to claim 13, wherein the tilting means comprise an inertia mass which rotates the tilting plate by an effect of an inertia of shooting a pellet, thus releasing the tooth and rotating the drum and a spring of the tilting means that rotates the tilting plate in an opposite direction, until reaching the initial position.

15. A pellet magazine according to claim 14, wherein:

the tilting means comprise an inertia mass that causes the tilting plate to rotate and move due to an inertia of a shot of a pellet, releasing the tooth and rotating the drum; and the spring is attached to a slot arranged in the tilting plate, the slot having a rotation axis being positioned therein, such rotation axis being positioned in one end of the slot when the pawl blocks one of the teeth and such rotation axis being positioned in another end of the slot when the pawl releases the tooth.

16. A pellet magazine according to claim 15, wherein the slot is oriented towards a central region of the tilting plate.

17. A pellet magazine according to claim 16, wherein the outer casing is closed by a lid and the rotation axis is integral with the lid.

18. A pellet magazine according to claim 15, wherein the inertia mass is located perpendicularly to the housings.

19. A pellet magazine according to claim 18, further comprising a push button which, when actuated, releases the pawl and unlocks the tooth.

20. A pellet magazine according to claim 14, wherein the inertia mass is located perpendicularly to the housings that receive the pellets.

21. A pellet magazine according to claim 20, further comprising a push button which, when actuated, releases the pawl and unlocks the tooth.

22. A pellet magazine according to claim 1, wherein the teeth are positioned outside the drum.

23. A pellet magazine according to claim 22, wherein the tilting means comprise an inertia mass which pushes an inertial body which ends at a pawl and pushes it against a lid of the magazine, which lid is initially separated from the inertial body at a predetermined spacing, by an effect of an inertia of shooting a pellet, thus releasing the tooth and rotating the drum, and a spring which rests on the lid pushes the inertial body in an opposite direction, blocking also the pawl to a following tooth and separating the new inertial body from the lid at the predetermined spacing.

24. A pellet magazine according to claim 23, wherein the predetermined spacing is larger than a height of the pawl.

25. A pellet magazine according to claim 24, wherein the inertia mass is located inside an inertial body.

26. A pellet magazine according to claim 25, wherein the inertial body comprises an extension which pushes the spring against the lid when the inertia mass pushes the inertial body.

27. A pellet magazine according to claim 26, wherein the inertia mass is positioned parallel to the housings.

28. A pellet magazine according to claim 27, further comprising a push button which, when actuated, releases the pawl and releases the tooth.

* * * * *